US005643434A

United States Patent [19]

Benmalek et al.

[11] Patent Number: 5,643,434

[45] Date of Patent: Jul. 1, 1997

[54] PROCESS FOR COATING THE FACE OF A PART MADE OF ALUMINUM OR ALUMINUM ALLOY

[75] Inventors: Mohamed Benmalek, Saint Martin D'Heres; Marc Santarini, Voiron, both of France

[73] Assignee: Aluminum Pechiney, Courbevoie, France

[21] Appl. No.: 594,949

[22] Filed: Jan. 31, 1996

[30] Foreign Application Priority Data

Feb. 2, 1995 [FR] France ..... 95 01405

[51] Int. Cl.[6] ..... C25D 15/00; C25D 11/04; C25D 11/20; C25D 5/44

[52] U.S. Cl. ..... 205/109; 205/172; 205/173; 205/181; 205/213; 205/214; 205/219; 205/271; 205/273

[58] Field of Search ..... 205/109, 172, 205/173, 181, 213, 214, 219, 271, 273

[56] References Cited

U.S. PATENT DOCUMENTS 3,531,379 9/1970 Peach ..... 205/172
5,139,586 8/1992 Das ..... 148/246

FOREIGN PATENT DOCUMENTS 51342 4/1990 Hungary .
49-48050 12/1974 Japan .
62-238393 10/1987 Japan .

OTHER PUBLICATIONS

Sato, "Electroplating on Aluminum", Chemical Abstracts, vol. 108, No. 12, (Mar. 21, 1988), p. 565.

French Search Report dated Oct. 5, 1995.

*Primary Examiner*—Kathryn L. Gorgos
*Assistant Examiner*—Edna Wong
*Attorney, Agent, or Firm*—Oblon, Spivak, McClelland, Maier & Neustadt, P.C.

[57] ABSTRACT

Process for the electrolytic deposition of composite nickel onto the face of a part of a motor vehicle, in particular the bore of a casing or engine block of an internal combustion engine comprising at least three successive stages, the first being an electrochemical activation stage where the part is brought to anodic polarity in a bath containing a halogenated acid salt of nickel, the second being a stage of superactivation of the surface and the third being a stage of electrolytic deposition of a nickel layer containing particles of solid substances where the part is brought to cathodic polarity in a nickel-plating bath containing a charge of solid particles of which the diameter is advantageously between 0.5 and 5 microns and which can be of silicon carbide or any other hardening element, optionally mixed with particles of graphite.

16 Claims, 1 Drawing Sheet

PROCESS FOR COATING THE FACE OF A PART MADE OF ALUMINUM OR ALUMINUM ALLOY

TECHNICAL FIELD OF THE INVENTION

Figure 1:
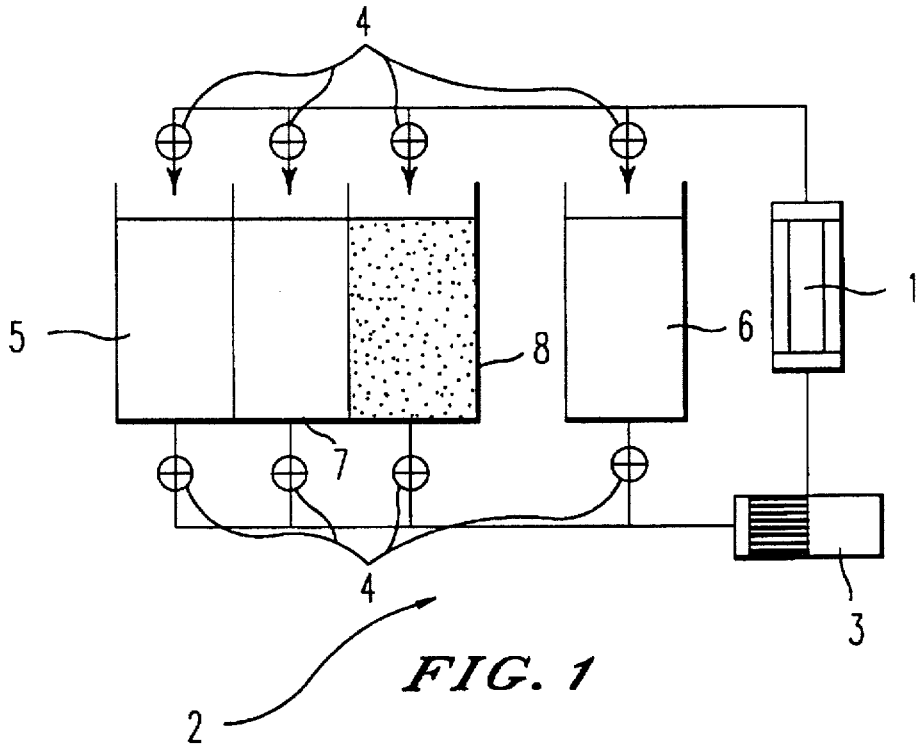

The invention relates to the field of parts made of aluminium or aluminium alloy having at least one face or one surface subjected to high frictional forces, in particular moulded or forged parts for motor vehicles. These include the casings provided in the internal combustion engines of motor vehicles or again cylinders which are machined directly in the engine block. The invention relates more particularly to the internal surface or bore of a casing or of an engine block which is subjected, while cold or hot, to high frictional forces and is sensitive to wear.

STATE OF THE ART

To produce aluminium alloy parts for motor vehicles, alloys which are easy to work, for example by moulding or forging, but which have characteristics of use and behaviour which are inadequate when subjected to high frictional forces are selected in the majority of cases. Such forces can be encountered in engines, for example at the internal surface of a casing or of an engine block barrel, also known as a cylinder housing, where the piston is guided in its reciprocating travel and where its segments are in constant contact with said surface. To improve the resistance to wear it is known from FR-A-1 579 266 and FR-A-2 159 179 to deposit on said internal surface a coating consisting of a composite of nickel and of solid particles, generally of silicon carbide.

The patent application FR-A-1 579 266 proposes a process for the galvanic deposition of a metallic coating containing solid particles. Deposition is carried out in two stages: a preparatory stage where a first layer of zinc is deposited chemically on the surface to be treated and a second stage which is the actual electrolytic deposition, the part to be treated being the cathode, this deposition itself taking place in two stages: firstly deposition of a fine layer of almost pure nickel then deposition of the nickel charged with solid particles.

This process, or variations thereof, is commonly used at present on a large scale both for aluminium alloy engine blocks and for cast iron engine blocks or casings, as the coating thus obtained not only increases the resistance to wear but also improves lubrication because it facilitates retention of the lubricant owing to the particles of silicon carbide which emerge from the nickel surface.

The patent application FR-A-2 159 179 proposes an improvement to the original process, involving mechanical preparation of the surface (shot blasting) followed by a soda attack and finally double zinc-plating with an intermediate nitric attack. As it improves the adhesion of the deposited layer, it is used for large scale manufacture but has the drawback of producing a layer of irregular thickness.

The patent application EP-A-0 288 364 discloses a process for the coating of cast iron engine block barrels where the initial deposition of zinc is replaced by an electrolytic sulphuric attack. This process allows better control of the thickness of the deposit but is not suitable for aluminium alloys.

The bore of a cylinder housing is the seat of piston travel and therefore has to be produced within very tight dimensional tolerances. The irregularity in the thickness of the deposited layer necessitates prolonged, awkward and expensive final. machining, generally by abrasion and grinding. Good geometric: precision of the deposit would obviate the need to repeat machining and would allow the thickness corresponding to the maximum wear expected of this coating to be aimed at from the outset. Furthermore, to increase the life of the engine, it is desirable to improve the resistance to wear of the coating and to reduce the friction of the segments of the piston which are displaced in contact with it, and this would have the further beneficial effect of reducing mechanical noises and vibrations of the engine.

SUBJECT OF THE INVENTION

The invention relates to a process for coating the face of a part made of aluminium or of aluminium alloy to be subjected to high frictional forces. It relates, more particularly, to the bore of a casing or of an engine block of an internal combustion engine. This process involves at least the three following successive stages:

an electrochemical activation stage where the part is brought to anodic polarity and which makes the surface to be coated very reactive a superactivation treatment which completes the effect of the first stage an electrolytic deposition stage where the part is brought to cathodic polarity.

In an advantageous manner, these operations can be separated by rinsing with pure water and follow one another within a very short period of time so the surface to be coated does not dry between each stage and without said surface having been exposed to the air or to any other environment causing its reactivity to drop.

During each galvanic stage according to the invention, an electrode having a shape resembling that of the surface to be treated is placed in the vicinity of said surface. In an advantageous manner, the same electrode can be retained for all operations, said electrode merely having to be brought to cathodic polarity in the first stage, zero polarity in the second stage and anodic polarity in the third stage.

The first stage according to the invention is an electrochemical activation phase where the surface to be treated and the electrode are in a bath containing a halogenated acid salt of nickel. This bath is preferably an aqueous solution containing nickel chloride, a fluorinated compound and boric or fluoboric acid. It is preferable to use an aqueous solution containing 100 to 250 grams of nickel chloride, 2 to 10 grams of ammonium bifluoride and 10 to 20 grams of fluoboric acid per liter of electrolyte.

A direct current is applied between the part acting as anode and the electrode acting as cathode. The current density is preferably between 10 and 50 A/dm$^2$ for 30 to 120 seconds, the bath being kept at a temperature between 40° C. and 60° C.

In an advantageous manner, an attempt will be made beforehand to prepare the surface to be treated with a succession of alkaline degreasing and alkaline pickling then fluoboric-nitric baths.

The second stage according to the invention is a superactivation treatment intended to complete depassivation of the surface to be coated and to dissolve the residues from the electrochemical treatment of the first stage which are likely to disturb the regularity and homogeneity of the future deposit. This superactivation treatment is preferably carried out with a fluoboric nitric bath and, more particularly, an aqueous solution containing between 20% and 50% by volume of nitric acid concentrated to 68% and between 20% and 75% by volume of fluoboric acid concentrated to 50%. The surface in contact with this bath is preferably kept at a temperature between 20° C. and 40° C. for a period of 30 to 120 seconds.

The third stage according to the invention is the phase of electrolytic deposition of the composite nickel. The bath is a nickel-plating bath containing a charge composed of solid particles which can be carbides, in particular silicon carbide, or any other component hardening the coating and improving the resistance to wear of the deposit (for example diamond), or a compound reducing the coefficient of friction (for example graphite), or a mixture of components from these two categories intended to provide the best compromise between resistance to wear and coefficient of friction corresponding to the intended use.

Said nickel-plating bath can advantageously comprise nickel sulfamate, nickel chloride, boric acid, saccharin and said charge of solid particles.

It is preferable to use a nickel-plating bath containing approximately 250 to 400 grams of nickel sulphamate, 20 to 40 grams of nickel chloride, 10 to 100 grams of boric acid and 50 to 150 grams of charge per liter of electrolyte. During the treatment, the bath is kept at a temperature between 40° C. and 60° C., whereas its pH is kept between 2 and 5, preferably between 2.5 and 3.5. The bath also contains saccharin which has the advantageous effect of reducing the residual stresses prevailing in the deposit. However, its concentration is limited because another effect of saccharin is to reduce the speed of deposition. One liter of nickel-plating bath preferably contains between 0.5 and 4 grams of saccharin.

A direct or pulsating current is applied between the part acting as cathode and the electrode acting as anode. The current density is preferably between 20 and 50 A/dm$^2$ for the period of time required to reach the desired thickness. For example, with a current density of 30 A/dm$^2$, a treatment of 15 minutes is required to obtain a layer of 45 μm at a temperature of about 50° C.

Further characteristics and advantages of the invention result from the synergetic effect of the combination of the first two stages and concern the constitution of the charge in solid. particles which is enriched and better adapted to the tribological properties desired in this type of deposit. Thus, said charge which contains particles which harden the coating such as particles of silicon carbide can be enriched with particles which improve the tribological conditions of contact such as particles of graphite. In an advantageous embodiment of the invention, this charge consists of between 5 and 50 grams of graphite powder per liter of nickel-plating bath.

Furthermore, all the particles of said charge according to the invention can reach a preponderant size of between 0.5 μm and 5 μm. In a preferred embodiment of the invention, particles of silicon carbide having a grain size of between 3 μm and 5 μm, that is sufficiently large to reduce the risks of seizing but not too large to prevent excessive wear of the other element in contact, are introduced. This same charge is enriched with particles of graphite having a finer grain size: 1 μm to 3 μm.

Analysis of the surface just after the second stage according to the invention has shown that metal nickel has been deposited in the cavities created by the acid attack and has not been completely dissolved by the superactivation bath, which is surprising owing to the polarity of the part in the first stage. These cavities constitute very reactive sites which promote attachment of the composite layer of nickel. The combination of the electrochemical activation of the first stage according to the invention and the superactivation of the second stage according to the invention constitutes a synergetic effect which allows the composite layer of nickel to be deposited immediately; therefore, it is not essential to deposit the fine layer of pure nickel recommended in the prior art at the beginning of the third stage.

The combination of electrochemical activation in the first stage according to the invention and superactivation in the second stage according to the invention improves the yield of the deposit in the third stage to such an extent that it is not necessary to attain the bath concentrations of the prior art to obtain the same concentration of charge in the deposited layer. This allows the charge to be enriched either with the same element to improve a given property or with other elements to impart other properties to it, with an identical bath viscosity; thus, for example, graphite powder which reduces the friction on starting and therefore reduces the risks of seizing can be added to the silicon carbide powder which improves the resistance to wear.

Owing to this synergetic effect, it is possible according to the invention to use solid particles which are much larger than in the prior art and this further improves the tribological quality of the coating while reducing the risks of seizing.

DRAWINGS

FIG. 1 is a diagram of a preferred embodiment given as a non-limiting example. According to this embodiment, the operations are limited, the wait between stages is minimal, and activation of the surface is not impeded by oxidation or passivation. The system is dynamic, that is to say the cell 1 for treatment of the part is not removed during the process and all the necessary baths are introduced successively within said cell 1. This is possible owing to the circuit 2 which comprises polypropylene pipes and a pump 3 allowing the circulation of fluids between their reservoir and the treatment cell. Depending on whether the various valves 4 of the circuit are open or closed, the pump firstly drives the bath for activating the tank 5, the bath for rinsing the tank 6, the bath for superactivation of the tank 7, a new rinsing bath and finally the nickel-plating bath of the tank 8.

Figure 2:
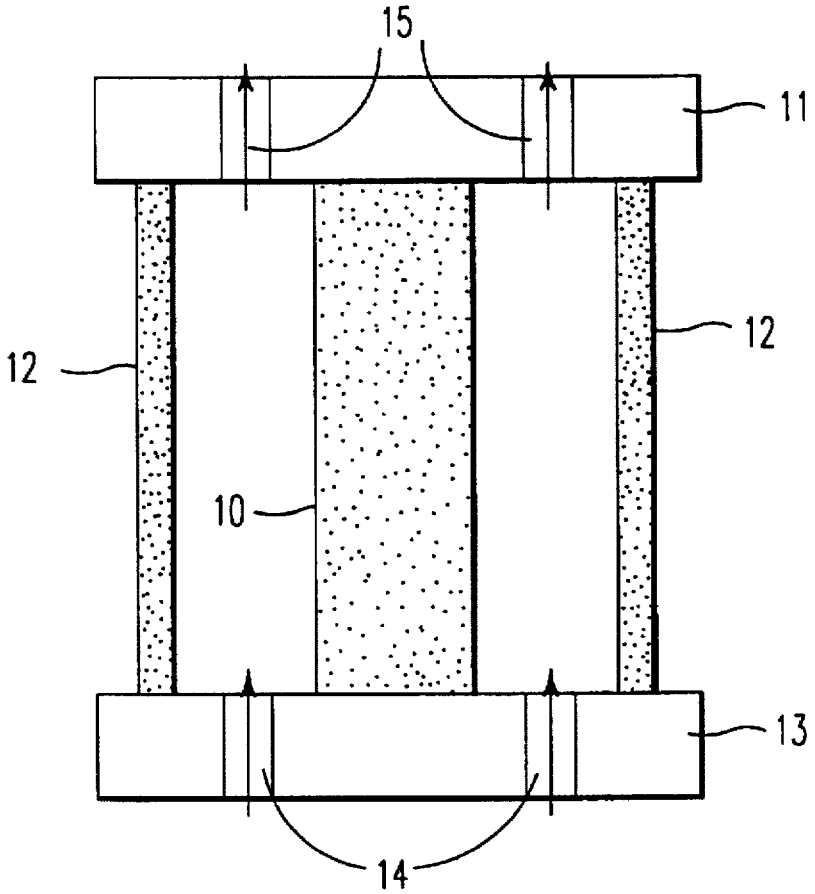

FIG. 2 is a basic diagram of the cell for treating the part to be coated. As an engine block is particularly bulky and heavy to manipulate, we have simplified the part by replacing it with a cylindrical casing 12 made of the alloy AS5U3G commonly used for engine blocks. This aluminium alloy comprises approximately 5% silicon, 3% copper and 0.3% magnesium. The electrode 10 is held by a support 11 covering the casing 12. The support 13 of the casing has a centering means which renders the electrode and the casing concentric.

The electrode support 11 and the casing support 13 hermetically surround the casing and allow the various fluids originating from the circuit in FIG. 1 to pass through the cavities 14 of the casing support 13 and the cavities 15 of the electrode support 11.

EXAMPLES

Example 1

Coating of fifty casing bores with a nickel-silicon carbide composite

Preliminary stage: Surface preparation

Various degreasing and pickling baths were first applied by immersion. In a more advanced industrial phase, it is quite feasible to include them in a circuit of the type shown in FIG. 1. The following treatments were applied:

ultrasonic alkaline degreasing for 2 minutes in a bath produced by the company, Diversey, reference D708, concentrated to 30 g/l and kept at a temperature of 60° C.

rinsing alkaline pickling for 2 minutes with a bath produced by the company, Diversey, reference Aluminux 136, concentrated to 50 g/l and kept at a temperature of 50° C.

rinsing fluoboric nitric pickling in a bath composed of 50% of nitric acid concentrated to 68% and 20% of fluoboric acid concentrated to 50% kept at ambient temperature for 30 seconds rinsing First stage: Electrochemical activation The electrochemical activating bath stored in the polypropylene tank 5 and kept at a temperature of 50° C. has the following composition:

| | |
|---|---|
| $NiCl_2$ | 125 g/l |
| $NH_4HF_2$ | 5 g/l |
| $H_3BO_3$ | 12.5 g/l |

It is brought to the treatment cell 1 by means of the pump 3 which has a maximum flow rate of 100 liters per minute. A current is passed for 30 seconds by means of a 40 V 300A generator so as to establish a current density of 28 A/dm$^2$.

Second stage: Superactivation

After rinsing and without waiting for the surface of the part to dry, the superactivation bath is passed into the cell. This bath has the following composition:

50% of nitric acid concentrated to 68%

20% of fluoboric acid concentrated to 50%

It is kept in contact with the surface for 30 seconds at 20° C.

Third stage: Electrolytic deposition of composite nickel

The nickel-plating bath used has the following composition:

| | |
|---|---|
| $Ni(NH_2SO_3)_2$ | 300 g/l |
| $H_3BO_3$ | 30 g/l |
| $NiCl_2$ | 30 g/l |
| saccharin | 2 g/l |

charge: silicon carbide 75 g/l having a mean grain size of 2 micrometers

It is distinguished from the prior art bath by a much higher chlorine content (#9 g/l) and by a much lower pH of about 3.

It is kept at a temperature of 50° C. and circulates toward the cell at a maximum flow rate of 100 liters per minute for 15 minutes for a mean deposit of 50 μm.

The deposit obtained is characterized by its adhesion, the regularity of the deposited thickness, the homogeneity of the particle distribution and by tests on friction and wear. The adhesion tests carried out follow the ASTM recommendations: B571-84 §9 (thermal shocks), the intended temperature of use being fixed at 200° C. and B571-84 §7 (file test).

The wear and friction tests were carried out on a "Plint" friction measuring instrument marketed by the company, Cameron, and commonly used in the automobile industry. These tests which we will call "Plint tribology tests" allow the wear of the two materials in contact (the coating and the material of the piston segment) and the coefficient of friction (Coulomb coefficient) to be measured.

Contact is of the cylinder-plane type, the cylinder representing the segment and the plane representing the bore of the engine. This plane is coated with the deposit to be tested. The cylinder/segment is subjected to a given load normal to the plane/bore against which it rubs and travels, at a given temperature, in a direction parallel to the cylinder axis with a reciprocating linear movement of given amplitude and frequency.

Results adhesion of the deposit: it is perfect whatever the test carried out regularity of thickness:

After meticulous positioning of the electrode relative to the casing, good regularity is observed in the deposited thickness: 45 to 55 micrometers for an intended 50 micrometers. No wear of the electrode was observed after these 50 depositions, implying good reproducibility of the results on an industrial scale.

homogeneity of the distribution of silicon carbide particles: it is good and, furthermore, no silicon carbide agglomerate has been observed Plint tribology tests on Ni—SiC deposits Three materials constituting the segments were tested: cast iron, chromium, molybdenum.

The applicants carried out tests at two temperatures for each material: 30° and 100° C. Each test was carried out under a normal load of 100N and with reciprocating travel over a range of 15 mm.

At 30° C., the lubricant used is decyl hydride, the frequency of reciprocating travel is 12 Hz and the test lasts 30 minutes.

At 100° C. the lubricant used is an inert, that is unloaded engine oil, the frequency of reciprocating travel is 16 Hz and the test lasts 120 minutes.

These tests led to the mean results shown in Table 1. In Table 1, the wear of the coating is characterized by a loss in weight expressed in milligrams. The wear of the segments is given qualitatively according to the appearance of the contact surface of the segment at the end of the test and is shown in the table by a number of crosses which increases with wear.

TABLE 1

| Material of segment | Temperature | Coefficient of friction Begin. | Middle | End | Coating wear | Segment wear |
|---|---|---|---|---|---|---|
| Cast iron | 30 | 0.225 | 0.115 | 0.115 | 1.1 | xxx |
| | 100 | 0.125 | 0.115 | 0.115 | 0.4 | xxx |
| Chromium | 30 | 0.140 | 0.125 | 0.115 | 2.1 | xxx |
| | 100 | 0.100 | 0.100 | 0.100 | 0 | xx |
| Molybdenum | 30 | 0.130 | 0.115 | 0.115 | 0.9 | x |
| | 100 | 0.115 | 0.105 | 0.105 | 0 | x |

Example 2

Coating of a bore with a nickel/silicon carbide/graphite composite

About ten casings were coated with a mixture of SiC+graphite.

The device used, the physical parameters and the baths are identical to those in the previous example except that 10, 20 or 30 g/l of carbon powder were added, the grains having a mean size of 2 microns.

Results

The deposit is matter and darker than in the previous example.

The adhesion tests are excellent.

As in the previous example, good regularity is observed in the deposited thickness with the same tolerance range.

Plint tribology tests on Ni—SiC+graphite deposits.

The same tribology tests as those presented in example 1 were carried out at a temperature of 30° C. on two segment materials: cast iron and chromium, and on three types of coating corresponding to three concentrations of graphite. These tests led to the mean results shown in Table 2 which also shows, as a reminder and a comparison, the results obtained at 30° C. with a graphite-free coating. The graphite concentration is expressed in grams per liter.

TABLE 2

| Material of segment | Graphite concentration | Coefficient of friction Peak | Begin. | Middle | End | Coating wear | Segment wear |
|---|---|---|---|---|---|---|---|
| Cast iron | 0 | 0.18 | 0.225 | 0.115 | 0.115 | 1.1 | xxx |
| | 10 | | 0.110 | 0.120 | 0.125 | 0 | x |
| | 20 | 0.12 | 0.110 | 0.130 | 0.150 | 0 | x |
| | 30 | | 0.110 | 0.140 | 0.150 | 0.1 | x |
| Chromium | 0 | 0.49 | 0.140 | 0.120 | 0.115 | 1.7 | xxx |
| | 10 | | 0.130 | 0.130 | 0.125 | 0.2 | x |
| | 20 | 0.15 | 0.130 | 0.115 | 0.125 | 0 | x |
| | 30 | | 0.130 | 0.115 | 0.145 | 0.2 | x |

Generally speaking, less wear is observed on these segments when the coating contains graphite. It is also noted that the contribution of graphite affects friction essentially at start up where the peak observed on the coefficient of friction drops noticeably with cast iron segments and spectacularly with chromium segments. It is finally noted that a concentration of 20 g/l of graphite combined with 75 g/l of SiC powder corresponds to the coating which is least worn at the end of this type of test.

Advantages of the invention excellent adhesion of the deposit owing to the activation stages uniformity of the thickness of the deposit which can vary by less than 5 μm owing to adaptation of the electrode configuration homogeneity of the distribution of particles (silicon carbides and graphite for example) in the deposit (up to about 15% by volume)

high deposition rate homogeneity of the products employed in all stages of this process slight roughness of the deposit allowing a reduction in the grinding time of the parts coated in this way

We claim:

1. A process for coating the surface of an aluminum or aluminum alloy part, comprising the following steps in the order shown:

a) electrochemically activating the surface of an aluminum or aluminum alloy part by bringing the part to anodic polarity in a bath comprising a halogenated acid salt of nickel;

b) superactivating the surface by chemical treatment; and c) bringing the part to cathodic polarity in a nickel-plating bath comprising solid particles, and electrolytically depositing a nickel layer containing solid particles on the surface of the part.

2. Process according to claim 1, wherein said electrochemical activating bath is an aqueous solution containing nickel chloride, a fluorinated compound and boric or fluoboric acid.

3. Process according to claim 2, wherein said electrochemical activating bath contains between 100 and 250 grams of nickel chloride, 2 and 10 grams of ammonium bifluoride and 10 and 20 grams of fluoboric acid per liter.

4. Process according to claim 3, wherein, during said electrochemical activation step, a current density of 10 to 50 A/dm$^2$ is applied for 30 to 120 seconds, the bath being kept at a temperature of between 40° and 60° C.

5. Process according to claim 1, wherein said electrochemical activation step is preceded by surface preparation steps of degreasing, alkaline pickling, and fluoboric-nitric pickling baths.

6. Process according to claim 1, wherein the bath used for the surface superactivation step is an aqueous solution containing between 20% and 50% by volume of nitric acid concentrated to 68% and between 20% and 75% by volume of fluoboric acid concentrated to 50%.

7. Process according to claim 6, wherein the bath used for the surface superactivation step is kept in contact with the surface to be coated for a period of between 30 and 120 seconds at a temperature of between 20°and 40° C.

8. Process according to claim 1, wherein the bath used in the electrolytic deposition step contains nickel sulphamate, nickel chloride, boric acid, saccharin and a charge comprising solid particles of any component which hardens the coating.

9. Process according to claim 8, wherein one liter of the bath used in said electrolytic deposition stage contains between 250 and 400 grams of nickel sulfamate, between 20 and 40 grams of nickel chloride, between 10 and 100 grams of boric acid, between 0.5 and 4 grams of saccharin and from 50 to 150 grams of said charge.

10. Process according to claim 9, wherein a current density of 20 to 50 A/dm$^2$ is applied during said electrolytic deposition step, the bath being kept at a temperature between 40° C. and 60° C. and at a pH between 2 and 5.

11. Process according to claim 8, wherein the bath used in said electrolytic deposition step contains a charge comprising solid particles of any component which hardens the coating, wherein said charge also contains graphite.

12. Process according to claim 11, wherein the bath used in said electrolytic deposition step contains between 250 and 400 grams of nickel sulfamate, between 20 and 40 grams of nickel chloride, between 10 and 100 grams of boric acid, between 0.5 and 4 grams of saccharin and from 50 to 150 grams of said charge per liter, the charge containing between 5 and 50 of graphite.

13. Process according to claim 12, wherein a current density of 20 to 50 $A/dm^2$ is applied during said electrolyte deposition stage, the bath being kept at a temperature between 40° and 60° C. and at a pH between 2 and 5.

14. Process according to claim 11, wherein the solid particles of said charge have a size defined by a mean diameter between 0.5 and 5 μm.

15. Process according to claim 1, wherein said electromechanical activation, chemical superactivation and electrolytic deposition steps follow one another, interrupted by rinsing with pure water, wherein said surface to be treated does not have time to dry or to be exposed to air or to any other environment likely to reduce its activity.

16. Process according to any one of claims 2, 5, 6, 8, and 15, wherein the part is a bore of a casing or engine block of an internal combustion engine of a motor vehicle, made of aluminum or aluminum alloy.

* * * * *

UNITED STATES PATENT AND TRADEMARK OFFICE

CERTIFICATE OF CORRECTION

PATENT NO. : 5,643,434

DATED : July 1, 1997

INVENTOR(S) : Mohamed BENMALEK, et al.

It is certified that error appears in the above-indentified patent and that said Letters Patent is hereby corrected as shown below:

On the title page, Item [54], and the top of Column 1, the title should read:

--PROCESS FOR COATING THE FACE OF A PART MADE OF ALUMINIUM OR ALUMINIUM ALLOY--

On the title page, Item [73], the assignee's name should read:

--ALUMINIUM PECHINEY--

Signed and Sealed this

Sixteenth Day of September, 1997

*Attest:*

*Attesting Officer*

BRUCE LEHMAN

*Commissioner of Patents and Trademarks*